US008468649B2

(12) United States Patent
Nielsen et al.

(10) Patent No.: US 8,468,649 B2
(45) Date of Patent: Jun. 25, 2013

(54) JOINT SYSTEM ARRANGED BETWEEN A DRIVEN TOOL AND A MANUAL STEERING MEMBER

(75) Inventors: Henrik Nielsen, Fontainebleau (FR); David Petitdemange, Vaux-le-Pénil (FR)

(73) Assignee: Nielsen Innovation, Fontainebleau (FR)

( * ) Notice: Subject to any disclaimer, the term of this patent is extended or adjusted under 35 U.S.C. 154(b) by 280 days.

(21) Appl. No.: 12/999,168

(22) PCT Filed: Jun. 18, 2009

(86) PCT No.: PCT/FR2009/051157

§ 371 (c)(1),
(2), (4) Date: Mar. 1, 2011

(87) PCT Pub. No.: WO2009/153525

PCT Pub. Date: Dec. 23, 2009

(65) Prior Publication Data

US 2011/0146026 A1 Jun. 23, 2011

(30) Foreign Application Priority Data

Jun. 19, 2008 (FR) ..... 08 03480

(51) Int. Cl.
*A47L 9/02* (2006.01)

(52) U.S. Cl.
USPC ..... 15/415.1; 15/411; 15/414

(58) Field of Classification Search
USPC ..... 15/414, 415.1, 144.1, 144.2, 143.1, 15/410, 411; 403/223, 225, 222, 227, 53
See application file for complete search history.

(56) References Cited

U.S. PATENT DOCUMENTS

| | | | | |
|---|---|---|---|---|
| 2,116,375 | A | 5/1938 | Aubitz | |
| 3,016,556 | A | 1/1962 | Greenleaf | |
| 6,125,502 | A * | 10/2000 | Hammeken et al. | 15/411 |
| 6,519,810 | B2 * | 2/2003 | Kim | 15/415.1 |
| 2006/0230567 | A1 | 10/2006 | Harper et al. | |
| 2010/0229339 | A1 * | 9/2010 | Lambourn | 15/415.1 |

FOREIGN PATENT DOCUMENTS

| | | | |
|---|---|---|---|
| DE | 3913419 | A1 | 10/1990 |
| EP | 1342445 | A2 | 9/2003 |
| WO | 9713445 | A1 | 4/1997 |

* cited by examiner

*Primary Examiner* — Dung Van Nguyen
(74) *Attorney, Agent, or Firm* — The Webb Law Firm

(57) ABSTRACT

The joint system comprises a first piece secured to a driven tool and suitable for pivoting about a horizontal axis, and a second piece secured to a manual steering member and articulated to the first piece about an axis orthogonal to the horizontal axis. According to the invention, at least the second piece is formed by a flexible structure having a longitudinal neutral axis and including a base fastened to the first piece of the tool, and a head fastened to the member; said base and said head being interconnected via a pair of splines that are opposite and parallel to the neutral axis and that extend in a plane transverse to the horizontal axis, it being possible for said pair to be flexed under the effect of a force applied orthogonally to its plane and transmitted by the manual member. The invention applies to the field of household electrical appliances.

13 Claims, 5 Drawing Sheets

JOINT SYSTEM ARRANGED BETWEEN A DRIVEN TOOL AND A MANUAL STEERING MEMBER

BACKGROUND OF THE INVENTION

1. Field of the Invention

The invention relates to a joint system arranged between a driven tool that is movable over a surface on which work is to be done, and a manual steering member, and that comprises a first piece secured to the tool and suitable for pivoting about a horizontal axis, and a second piece secured to the member and attached to the first piece, and mounted to be articulated about an axis arranged in a plane orthogonal to the horizontal axis.

2. Description of Related Art

Joint systems of the universal type are already known that procure articulation about two orthogonal axes in such a manner as to enable the movement of the tool to be governed by the directional drive applied to the manual member.

Such a joint is described, for example, in US Patent 2006/0230567.

With such a construction, it can be understood that not only can the first piece pivot in a vertical plane extending in the direction of forward or backward movement of the tool, but also the second piece, by being articulated to said first piece, makes it possible for the manual member to move in planes that are transverse to the movement of the tool, allowing the member to be steered laterally to the right or to the left. In addition, the combination of such pivoting and of such articulation causes the direction of the tool on the surface on which work is to be done to be governed by the drive of the manual member so that turning the manual member to the right causes the tool to pivot to the right and vice versa, and in particular causes said tool to pivot at right angles.

Thus, the tool, in the general shape of a rectangular block, can work equally well transversely to the movement for cleaning a large surface as longitudinally thereto, so as to reach into small spaces.

However, it can be observed that the numerous component parts of such a joint system of the universal type having axes coinciding at a point, are very mechanical and must be molded and assembled with precision in order to enable pivoting and articulation to take place without any problem of dislocation or of seizing.

In addition, such a system gives rise to high manufacturing costs.

Joint systems also exist such as described in U.S. Pat. No. 3,016,556 that concerns a helical spring having touching turns that is designed for going around obstacles, but that is no way suitable for transmitting controlled directional torque.

SUMMARY OF THE INVENTION

An object of the invention is thus to mitigate the drawbacks of the prior art by providing a joint system that is of highly simplified design, that is robust, that does not need any painstaking assembly operation, and that makes the tool very convenient to move in all drive member positions and on all surfaces to be cleaned, even surfaces situated under certain pieces of furniture.

According to the invention, at least the second piece is formed by a flexible structure having a longitudinal neutral axis and including a base fastened to the first piece of the tool, and a head fastened to the member; said base and said head being interconnected via a pair of splines that are opposite and parallel to the neutral axis and that extend in a plane transverse to the horizontal axis, it being possible for said pair to be flexed under the effect of a force applied orthogonally to its plane and transmitted by the manual member.

Thus, in particular, the flexible structure of the second piece not only removes the constraint of having to assemble a joint to a pivotally mounted first piece with precision, but also eliminates any mechanical rigidity, or even jamming, occurring at extreme angular positions imposed by the manual member.

In addition, by means of this particular construction, a joint is achieved that is particularly simple, robust, and easy to mount and thus of lower manufacturing cost. Such a joint system may, for example, by mounted on a mop whose tool is constituted by a baseplate that is in the general shape of a rectangular block and that carries a textile covering.

A universal-type joint system has also been proposed for equipping mops of the type described in U.S. Pat. No. 5,988,920, and in which the tool is fed, via a flexible tube passing through the joint, with a cleaning liquid flowing by gravity and stored in a tank secured to the drive member.

A recurrent problem with that type of mop is the complexity of inserting the tube into the joint and the tube being pinched to some extent in the joint system, thereby stopping the liquid from being dispensed when excessive curvature is imparted to the joint system under drive from the manual steering member.

Another object of the invention is thus to mitigate that malfunctioning.

According to another particularly advantageous characteristic of the invention, the flexible structure of the second piece is tubular in general shape with the splines extending along diametrically opposite generator lines in such a manner as to enclose a hose for conveying a fluid; the base and the head having respective orifices suitable for allowing said hose to pass through.

This assembly made up of a rigid first piece associated with a flexible second piece is thus suitable for enclosing a fluid-conveying hose that has almost the same cross-section as the tubular flexible assembly.

By means of this construction, regardless of the curvatures given to the second piece, the hose continues to have a cross-section that is almost constant, significantly reducing the fluid head loss. In addition to being used for a mop or a brush, such a joint system is particularly suitable for solving the problem of sucking up dust in vacuum cleaners.

In addition, this flexible assembly makes it possible, simply and smoothly, for the drive of the tool to be governed by the control of the manual member either for working on large surfaces or in nooks and crannies, or for passing under low furniture such as beds.

In a variant embodiment of the invention, the first piece is also formed by a flexible tubular structure having a longitudinal neutral axis and made as a single assembly with the second piece; said first piece having a fastening foot for fastening to the tool, two splines that are opposite and parallel to the neutral axis and that are connected respectively to said foot and to an intermediate support supporting a pair of opposite and parallel splines that are connected to a head fastened to the member and that extend in a plane orthogonal to the plane containing the pair of splines; said pair of splines being provided with a series of rings that are spaced apart axially.

This particular embodiment in a single flexible assembly allowing combined pivoting and articulation movements to take place is particularly simple and inexpensive to manufacture because it is made by molding in one piece and does not require any complex fastening to the tool and to the manual member.

BRIEF DESCRIPTION OF THE DRAWINGS

The characteristics and advantages of the invention also appear from the following description, given by way of non-limiting example, and with reference to the accompanying drawings, in which.

DESCRIPTION OF THE PREFERRED EMBODIMENTS

Figure 1:
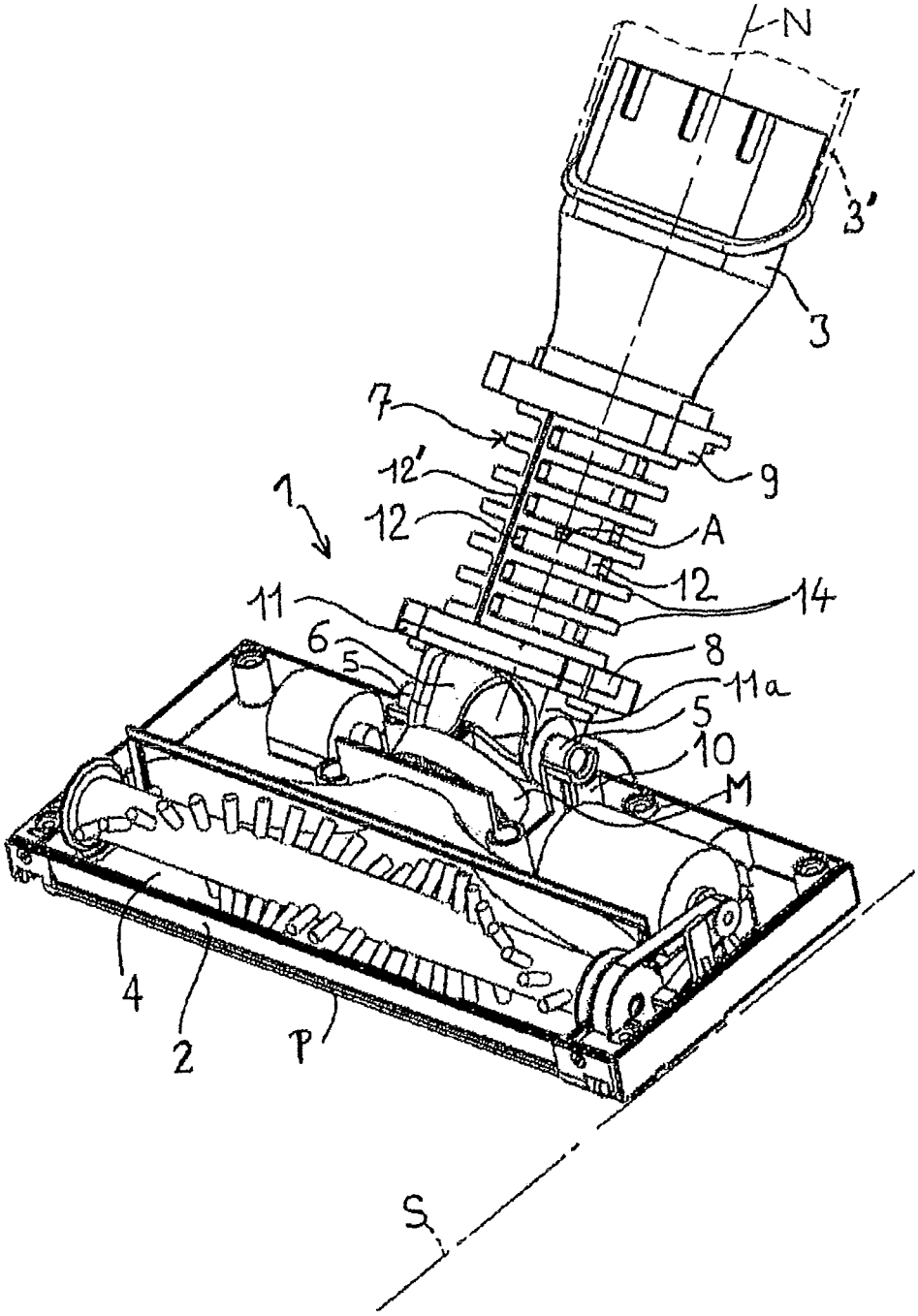
FIG. 1 is a perspective view of a joint system of the invention as mounted on a tool such as a vacuum cleaner nozzle without the cover and its suction hose being shown.
Figure 2:
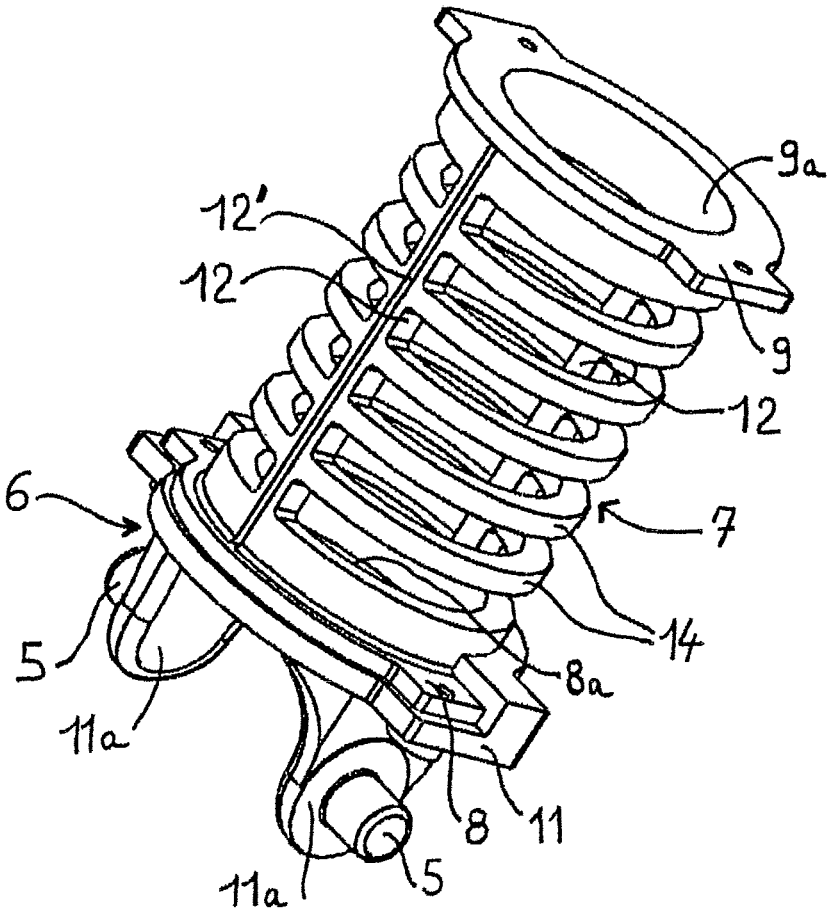
FIG. 2 is a perspective view, on a larger scale, of the FIG. 1 joint system shown on its own.

With reference to FIG. 1, the joint system, designated overall by reference 1, is designed to be arranged between a driven tool 2 that is movable over a surface S on which work is to be done and a manual steering member 3.

In the example shown, the tool is a nozzle having a suction mouth 4, and the steering member 3 is formed by the combination of a rigid sleeve and of a hollow stick or "handle" 3' that is associated therewith and that is connected via a tube (not shown) to the housing of a vacuum cleaner (not shown).

In general manner, this joint system comprises a first piece 6 secured to the tool 2 and suitable for pivoting about a horizontal axis, and a second piece 7 secured to the member 3 and attached to the first piece, and mounted to be articulated about an axis A arranged in a plane orthogonal to the horizontal first axis.

Said first piece 6, as shown in FIGS. 1 to 4, has a platform 11 to which the second piece 7 is fastened and that is carried remotely from the horizontal axis by two opposite transverse lugs 11*a* that are U-shaped in general, each of which lugs supports a respective stub axle 5.

Naturally, it is known from the prior art that this "universal" type of joint system can be used not only on tools such as vacuum cleaner nozzles, but also on tools such as sole-pieces equipped with washing or polishing cloths or wipes and mounted on mops, in which the manual member is constituted by a stick.

Most of such tools have a sole-piece or a housing that is in the general shape of a rectangular block, and in which one of the large faces can be said to be a "working front face".

In accordance with the invention, the joint system is characterized in that at least the second piece 7 is formed by a flexible structure having a longitudinal neutral axis N and including a base 8 fastened to the first piece 6 of the tool and a head 9 fastened to the member 3; said base and said head being interconnected via a pair of splines 12 that are opposite and parallel to the neutral axis N and that extend in a plane transverse to the horizontal axis, it being possible for said pair 12 to be flexed under the effect of a force applied orthogonally to its plane and transmitted by the manual member 3.

In a preferred embodiment, the second piece 7 that has a flexible structure is made in one piece made of a plastics material, the pair of splines 12 having flexibility characteristics enabling it to achieve bending through an angle of curvature lying in the range zero degrees to ninety-five degrees.

As shown in FIGS. 1 to 4, the first piece 6 is rigid and has a platform 11 to which the second piece 7 is fastened and that is carried remotely from the horizontal axis by two opposite transverse lugs that are generally U-shaped, each of which lugs supports a respective stub axle 5. The horizontal axis is defined by the two stub axles 5 lying in bearings 10 integral with the housing or more precisely integral with a baseplate P of the tool.

By means of this embodiment in which the flexible splines are attached at their ends to the base and to the head, it is possible to obtain a joint system that procures rigidity in the plane containing said splines and transverse flexibility allowing articulation in two opposite directions relative to said plane of the splines. It can be understood that it is easy to manufacture said second piece by mass-production molding, and to mount it in a single operation on all known tools, thereby contributing to procuring a low cost. Another advantage related to this embodiment in the form of a single flexible structure is that parts are no longer discarded for reasons of non-compliance with the manufacturing dimensions and/or with the dimensions for assembling the second piece on the first piece.

In order to combine great pivoting flexibility with good crushing strength when thrust is exerted along the neutral axis, the flexible material is a plastic having a modulus of elasticity approximately in the range 250 megapascals (MPa) to 350 MPa, e.g. a plastic of the polyethylene or composite type.

In view of the stresses exerted on this type of joint system, the invention also makes provision for each spline 12 to be provided with a groove (12') for receiving a flexible reinforcement (not shown). This reinforcement may preferably be made of a metal wire of the piano wire type or by a nylon thread. Said reinforcement may also be inserted by overmolding while the piece is being molded.

Figure 3:
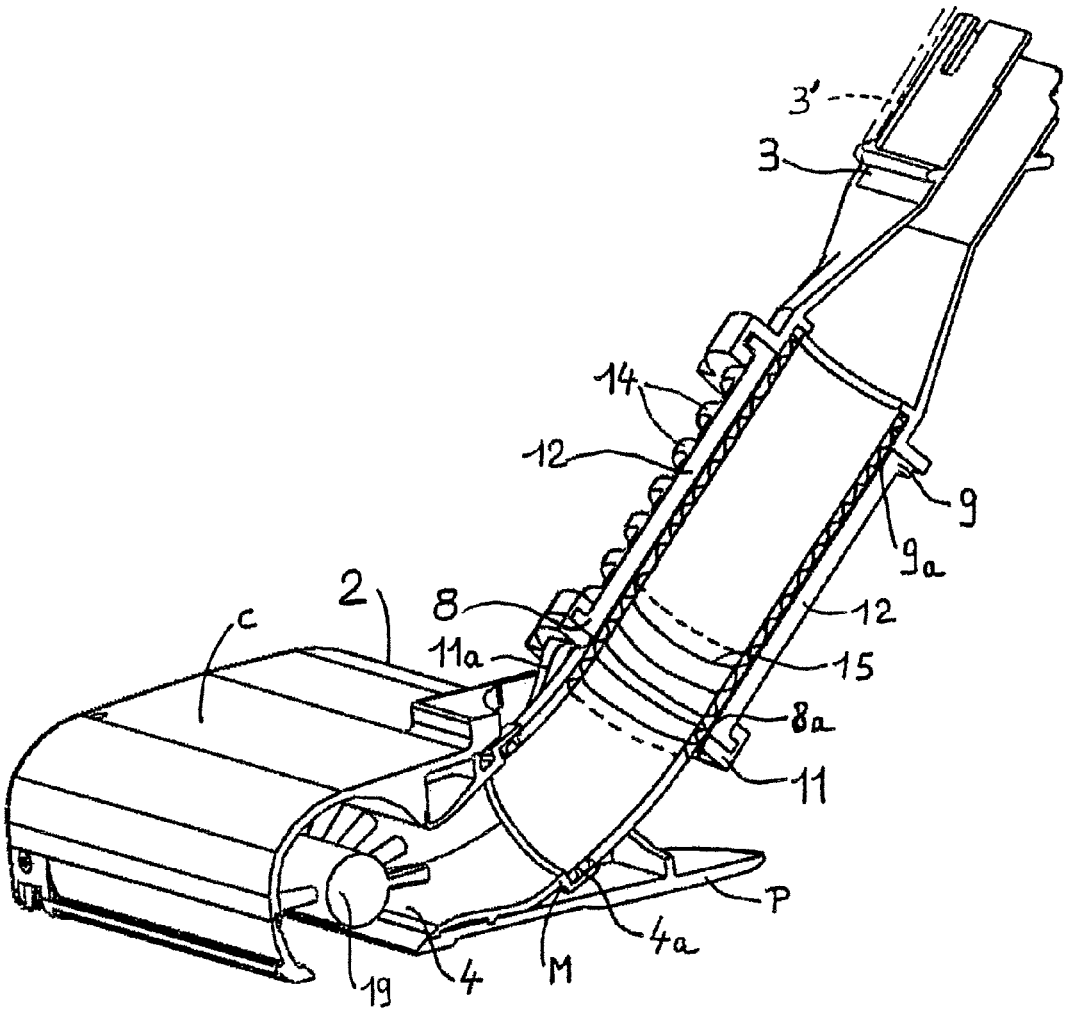
FIG. 3 is a view in vertical section on a midplane of the nozzle of FIG. 1, with the cover and a suction hose internal to the system being shown.

With reference to FIGS. 1 and 3, and according to another important characteristic of the invention, it can be observed that the flexible structure of the second piece is tubular in general shape with the splines 12 extending along diametrically opposite generator lines in such a manner as to enclose a flexible hose 15 (FIG. 3) for conveying a fluid; the base 8 and the head 9 having respective orifices 8*a*, 9*a* (FIG. 2) suitable for allowing said hose to pass through.

This tubular shape also makes it possible to procure good and simple fastening respectively to the platform 11 provided with an axial orifice, and to the member 3 that also has a complementary tubular shape. For example, such fastening may be obtained by assembly using screws, or by mechanical locking. This construction is explained more clearly below in a specific application.

In such a manner as to obtain uniform curvature and control over the reactivity to the various stresses exerted on the flexible structure, said flexible structure has a series of rings 14 between the base 8 and the head 9, which rings are spaced apart axially and are connected to the splines 12, thereby forming an openwork cage.

These rings limit the extent to which the flexible structure can move, and they guarantee a constant radius of curvature while distributing the stresses. The rigidity of the hose is, in particular, a function of the cross-section given to the splines. The larger said cross-section, the more the rigidity is increased.

The joint system that is thus made in two secured-together pieces, namely a rigid piece 6 and a flexible piece 7, acts by combining movements induced under drive from the manual steering member to procure pivoting about the stub axles 5 forming the axis of the assembly made up of the rigid piece and of the flexible piece, which pivoting is upwards or downwards in a vertical plane containing the neutral axis, to procure articulation of the flexible piece in one or more planes that are transverse to said axis A, and also, concurrently, to procure a change of direction of the tool in a turning movement about said neutral axis induced by said member on the two secured-together rigid and flexible pieces.

The pivotal movement is generally used to adapt the manual member to the height of the user, to the almost vertical position or "stowage" position, and to the extra-low position for passing under furniture. In addition, this pivotal movement of the rigid piece 6 about the stub axles 5 on the bearings 10 takes place without stress and prevents the working front face from lifting in undesired manner, in particular while the tool is advancing with the manual member in the lowered position. The transverse articulation movement makes it possible to procure the various sweeping positions while the tool is advancing over the surface on which the work is to be done.

The change of direction, procured by two orthogonal pairs formed by the assembly made up of the stub axles and of the splines co-operating in a manner governed by the turning movement of the manual member and by the articulation movement, is used to bring the tool rightwards or leftwards while it is advancing, with a view, in particular, to using the tool with its smaller dimension forwards, with its working front face parallel to the direction of advance, so as to go into the nooks and crannies or other small spaces.

By means of this construction in the form of an openwork cage, and in particular by means of the tubular shape of the cage, it is possible to use the joint system equally well for a washing or polishing mop equipped with a cleaning or polishing fluid dispenser, as for an electrical vacuum cleaner nozzle, even though, naturally, the cross-sections of the hoses differ as a function of the flow rate of fluid that they are to pass.

Thus, as shown in FIG. 3, and in a preferred application of the invention, the openwork cage of the flexible structure encloses the hose 15 of the corrugated type that is shown diagrammatically and that is of diameter that can be relatively large, and of the order of 35 millimeters (mm). The hose 15 passes not only through said cage, but also through the first piece 6 via the orifice provided axially in the platform 11, and it passes between the stub axles 5 and the bearings 10 until it connects via its bottom end to a sleeve M having a suction opening 4*a* mounted upstream from the mouth 4, while its top end is fastened to the member 3. Fastening the hose 15 to the head 9 and to the sleeve M may be achieved by adhesive bonding or by mechanical locking, or indeed by overmolding with the flexible structure 7.

The hose makes it possible, in optimal manner, for air to flow from the suction mouth 4 of the nozzle 2, via the opening 4*a*, to the steering member 3 formed, in this example, by the hollow stick 3' that is itself connected to a suction tube (not shown).

In addition to protecting the hose from impacts, the cage, made in one piece with multiple rings, makes it possible to steer and to accompany the hose in all of its pivoting, bending, and turning movements without causing pinching or significant reduction in the flow section for the fluid, or axial compaction during high thrust from the steering member in the direction of advance of the nozzle tool.

Figure 4:
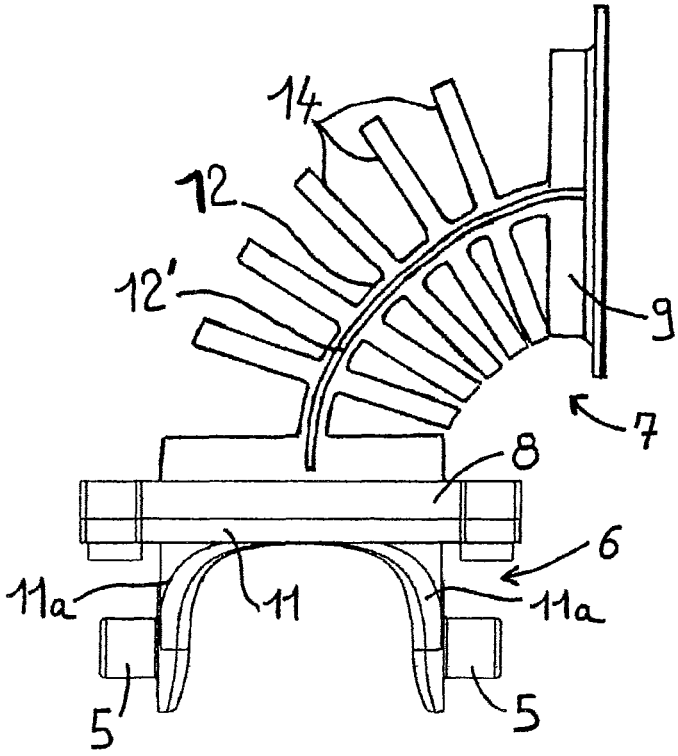
FIG. 4 is a diagrammatic elevation view of the joint system on its own, on another scale, in the position in which it is bent over at right-angles.

During a bending movement, shown in FIG. 4, through an angle of about ninety degrees and caused, in particular by putting the tool in a position in which it is in a direction that is transverse to the direction of advance, the rings, in their compression zone, are almost touching and thereby guarantee uniform curvature without kinking or pinching the internal flexible hose.

Figure 5:
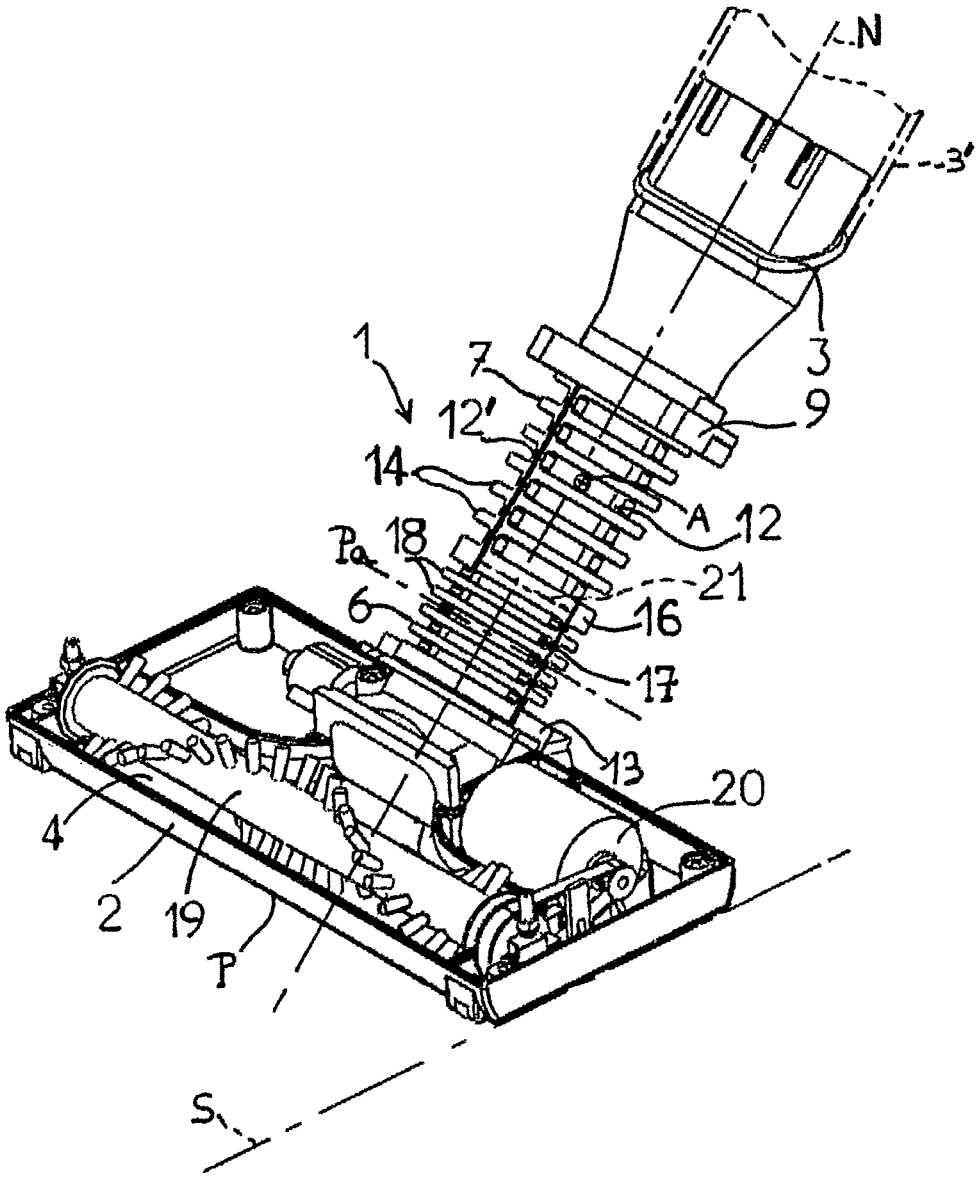
FIG. 5 is a view similar to FIG. 1, on a smaller scale, showing a variant embodiment of a joint system of the invention.

In a variant embodiment shown in FIG. 5 and in which like references are used to designate similar parts, instead of having the rigid piece, the joint system comprises a first piece 6 formed by a tubular flexible structure having a longitudinal neutral axis and made in one piece with a second piece 7; said first piece 6 has a fastening foot 13 for fastening to the tool, two splines 17 that are opposite and parallel to the neutral axis and that are connected respectively to said foot and to an intermediate support 16 supporting a pair of opposite and parallel splines 12 that are connected to a head 9 fastened to the member 3 and that extend in a plane orthogonal to the plane containing the pair of splines 12; said pair of splines 17 being provided with a series of rings 18 that are spaced apart axially.

The joint system, as made in a single molded piece in this way, can, by means of the combination of the two pairs, and under drive from the manual steering member, procure pivoting of the assembly upwards or downwards in vertical plane containing the neutral axis, articulation in one or more planes that are transverse to the neutral axis, and also or concurrently, a change of direction of the tool in a turning movement about said neutral axis induced by said member.

These various movements are optimized by the construction and by the arrangement of the axes Pa and A that are situated spaced apart on the neutral axis of the assembly on either side of the support 16.

Tests conducted for this variant embodiment of the invention have established that the spacing between the rings should preferably be chosen to be different in each pair in such a manner as to obtain different bending curvatures. In this example, the pair of splines 17 are provided with close-together rings 18 for bending the piece 6 with a uniform curvature lying in the range zero degrees to forty-five degrees, whereas the rings 14 of the pair of ribs 12 are spaced further apart, thereby allowing the piece 7 to bend with a greater curvature through an angle approximately in the range 90 degrees to 95 degrees.

In the example shown in FIG. 5, the piece 6 with its close-together rings makes it possible, while the manual member is pivoting in a vertical plane for lowering or raising the manual member, for the user to transmit this movement more easily and to lift off the working front face of the nozzle slightly with ease so as to suck up debris of size larger than dust.

With reference to FIGS. 1 to 5, the nozzle tool 2 has a baseplate P that is rectangular block shaped, that is covered with a cover C, and that has its front portion provided with a wide suction opening forming the suction mouth 4 through which a portion of a cylindrical brush 19 passes that is driven by an electric motor 20. The baseplate is provided with means for receiving a joint system that are adapted to the construction thereof, which joint system is either the one with a rigid piece and with a flexible piece, or the variant with the assembly of the two flexible pieces.

With reference to FIGS. 1 and 3, the flexible structure of the second piece 7 is installed via its annular base 8 on the platform 11 mounted to pivot on the bearings 10 installed in the back region of the cover C, while the annular head 9 is secured to the steering member 3 that can either be the hollow stick 3' connected via a tube to the housing of a vacuum cleaner of the canister type (not shown), or else the housing of a vacuum cleaner of the upright type (not shown) having a front portion that is provided with a suction duct and that is fastened to the head 9, and another portion that is provided with a drive handle.

Since the nozzle is of the type having a rotary brush driven by an electric motor, at least one of the splines 12 or, in the variant, the splines 12 and 17 is/are adapted to receive an electrical conductor (not shown) connected to the vacuum cleaner, and through the base 8 to the motor 20 or, in the variant, and for this purpose, the support 16 is provided over its periphery with a channel shown diagrammatically at 21 that is connected to said splines and that is designed to receive said electrical conductor.

Thus, by optimizing the construction of the joint system and, correlatively, by significantly reducing the head loss in the suction hose, it is possible to reduce the power of the motor-and-fan unit of the vacuum cleaner, and thus to make energy savings.

Such a joint system is particularly remarkable by how simple it is to manufacture, and indeed to mass-produce, and by how inexpensive it is compared with the prior art system that uses various molded parts that must be assembled together with precision. Such a joint system that is formed either by a flexible piece that is secured to a rigid piece, or by an assembly of two flexible pieces that are secured together may thus replace universal joint systems arranged on tools of any mops or other cleaning implements, regardless of whether or not such tools are equipped with hoses, and in particular arranged on vacuum cleaner nozzles, while offering convenience of use in extreme operating angular positions imposed by the manual member, and while also minimizing the head loss in the suction hose.

The invention claimed is:

1. A joint system arranged between a driven tool that is movable over a surface on which work is to be done, and a manual steering member, and that comprises a first piece secured to the tool and suitable for pivoting about a horizontal axis, and a second piece secured to the member and attached to the first piece, and mounted to be articulated about an axis arranged in a plane orthogonal to the horizontal axis;

wherein at least the second piece is formed by a flexible structure having a longitudinal neutral axis and including a base fastened to the first piece of the tool, and a head fastened to the member; with said base and said head being interconnected via a pair of splines that are opposite and parallel to the neutral axis and that extend in a plane transverse to the horizontal axis, it being possible for said pair to be flexed under the effect of a force applied orthogonally to its plane and transmitted by the manual member.

2. The joint system according to claim 1, wherein the second piece having a flexible structure is made in one piece of a plastic material, with the pair of splines having flexibility characteristics enabling it to obtain bending through an angle of curvature lying in the range zero degrees to ninety-five degrees.

3. The joint system according to claim 2, wherein the plastic material is a plastic having a modulus of elasticity approximately in the range 250 MPa to 350 MPa.

4. The joint system according to claim 1, wherein each spline is provided with a groove for receiving a flexible reinforcement.

5. The joint system according to claim 1, wherein the flexible structure of the second piece is tubular in general shape with the splines extending along diametrically opposite generator lines in such a manner as to enclose a hose for conveying a fluid; with the base and the head having respective orifices suitable for allowing said hose to pass through.

6. The joint system according to claim 5, wherein, between the base and the head, the second flexible piece has a series of rings that are spaced apart axially and that are connected to the splines, thereby forming an openwork cage.

7. The joint system according to claim 6, wherein the spacing between the rings of each pair is different in such a manner as to obtain a different bending curvature.

8. The joint system according to claim 5, wherein the first piece and the flexible second piece enclose a single hose for conveying a fluid.

9. The joint system according to claim 5, wherein the first piece is rigid and has a platform that is carried remotely from the horizontal axis formed by two stub axles carried by two opposite transverse lugs, each of which supports a respective one of the stub axles; said platform being provided with an orifice.

10. The joint system according to claim 5, wherein the first piece is also formed by a flexible tubular structure having a longitudinal neutral axis and made as a single assembly with the second piece; with said first piece having a fastening foot for fastening to the tool, two splines that are opposite and parallel to the neutral axis and that are connected respectively to said foot and to an intermediate support supporting a pair of opposite and parallel splines that are connected to a head fastened to the member and that extend in a plane orthogonal to the plane containing the pair of splines; said pair of splines being provided with a series of rings that are spaced apart axially.

11. The driven tool including a joint system according to claim 5, wherein it is a nozzle that is designed to equip a dust vacuum cleaner and that comprises a baseplate and a cover; said baseplate being provided with means for receiving said joint system, while the steering member is formed by a stick fastened to the head and connected via a tube to the housing of a vacuum cleaner.

12. The driven tool including a joint system according to claim 5, wherein it is a nozzle that is designed to equip a dust vacuum cleaner and that comprises a baseplate and a cover; said baseplate being provided with means for receiving said joint system, while the steering member is formed by a housing of a vacuum cleaner of the upright type having a front portion that is fastened to the head, and another portion that is provided with a drive handle.

13. The driven tool including a joint system according to claim 5, wherein it is of the type constituted by a nozzle having a rotary brush driven by an electric motor, and at least one of the splines, is adapted to receive an electrical conductor, or else each of the splines of a pair receives conductive reinforcement forming an electrical link between the vacuum cleaner and the motor.

* * * * *

UNITED STATES PATENT AND TRADEMARK OFFICE

CERTIFICATE OF CORRECTION

PATENT NO. : 8,468,649 B2
APPLICATION NO. : 12/999168
DATED : June 25, 2013
INVENTOR(S) : Nielsen et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 351 days.

Signed and Sealed this
Eighth Day of September, 2015

Michelle K. Lee

Michelle K. Lee
*Director of the United States Patent and Trademark Office*